US006593516B1

(12) United States Patent
Schafer et al.

(10) Patent No.: US 6,593,516 B1
(45) Date of Patent: Jul. 15, 2003

(54) HOLDER FOR A MUSICAL INSTRUMENT REED

(75) Inventors: Debra L. Schafer, Sherman Oaks, CA (US); Robert Stephen, Laverne, CA (US); Mark Balderrama, Laverne, CA (US); Christopher J. Noblet, Calabasas Hills, CA (US); Brian L. Terrell, Palmdale, CA (US)

(73) Assignee: Rico Corp., Sun Valley, CA (US)

( * ) Notice: Subject to any disclaimer, the term of this patent is extended or adjusted under 35 U.S.C. 154(b) by 0 days.

(21) Appl. No.: 10/262,837

(22) Filed: Oct. 3, 2002

(51) Int. Cl.[7] ..... G10D 9/02
(52) U.S. Cl. ..... 84/383 A; 84/383 R
(58) Field of Search ..... 84/383 R, 383 A, 84/380 R, 453

(56) References Cited

U.S. PATENT DOCUMENTS

| | | | | |
|---|---|---|---|---|
| 555,561 | A | | 3/1896 | Cadwallader |
| 1,625,651 | A | | 4/1927 | Gretsch |
| 1,779,522 | A | | 10/1930 | Widmayer |
| 2,310,908 | A | | 2/1943 | Neuerburg |
| 2,545,599 | A | | 3/1951 | Bartlett |
| 2,910,173 | A | | 10/1959 | Fenburr |
| 3,203,298 | A | | 8/1965 | Sumrall, Jr. |
| 3,344,913 | A | | 10/1967 | Best |
| 4,056,997 | A | * | 11/1977 | Rovner ..... 84/383 R |
| 4,172,482 | A | | 10/1979 | Gomez |
| 4,185,535 | A | * | 1/1980 | Lorenzini ..... 84/383 R |
| 4,352,428 | A | | 10/1982 | Pascucci et al. |
| 4,674,630 | A | * | 6/1987 | Kirck ..... 206/205 |
| 4,745,838 | A | * | 5/1988 | Johnson ..... 84/383 R |
| 4,796,507 | A | | 1/1989 | Stibal |
| 5,221,004 | A | | 6/1993 | Murphy |
| 5,289,752 | A | * | 3/1994 | Barbaglia ..... 84/383 R |
| 5,303,628 | A | | 4/1994 | Salazar |
| D399,714 | S | | 10/1998 | Grossi et al. |
| D409,370 | S | | 5/1999 | Wasser |

* cited by examiner

*Primary Examiner*—Kim Lockett
(74) *Attorney, Agent, or Firm*—Richard C. Litman

(57) ABSTRACT

A holder for a single musical instrument reed provides the proper pressures upon a reed being held therein, to assure that a moist reed will dry properly without warping after use. The present holder has a laterally bowed, outwardly convex first panel and an opposite flat second panel, with the reed fitting therebetween. A pair of longitudinal ribs extend along the inner surface of the first panel and bear against the curved surface of the reed stored therein, to hold the opposite flat surface of the reed securely against the flat inner surface of the second panel and assure that the reed cannot bend or warp within the holder. The holder is preferably formed of a polyethylene plastic material, which allows the sides to be flexed inwardly to bow the first panel away from the reed, thereby allowing the reed to be withdrawn from the holder.

19 Claims, 3 Drawing Sheets

HOLDER FOR A MUSICAL INSTRUMENT REED

BACKGROUND OF THE INVENTION

1. Field of the Invention

The present invention relates generally to containers and packaging, and more specifically to a flat, elongate sleeve for containing a musical instrument reed for sale (with additional packaging) and for storage and transport after sale and use. The present musical instrument reed holder secures the reed therein and holds the reed in the proper shape, thereby preventing warping of the reed as the reed dries after use.

2. Description of the Related Art

Certain types of musical wind instruments utilize vibrating reeds within or adjacent to the mouthpiece in order to resonate the column of air moving through the instrument. While the term "reed" originally referred to the preferred material of which such components are made, such "reeds" today may be formed of a wide variety of other materials, e.g., thin metal, plastic, etc., if so desired. However, reeds formed of cane or other natural wood material are preferred, for the various qualities provided by such natural materials.

Such reeds formed of natural materials are not without their drawbacks, however. The very nature of such reed type wind instruments results in a very moist and humid environment for the reed when the instrument is played, due to the moisture imparted by the breath of the person playing the instrument. While metal and plastic reeds are essentially impervious to such affects, reeds made of cane or other natural material will absorb the moisture from the player's breath. In fact, such natural materials will absorb a certain amount of moisture from the ambient atmosphere, in very humid conditions. The absorption of moisture, from whatever source, results in the natural reed warping and swelling, and taking on a shape other than that desired for optimum performance.

Drying the reed will also result in changing its shape and configuration, with the reed sometimes taking on a different shape than that which is desired. In fact, drying the reed too rapidly may result in the reed splitting or otherwise being damaged, as moisture evaporates from the external portions first and causes them to shrink, while the center of the reed remains moist and swollen. Obviously, a reed which is not configured properly, will affect the tone of the instrument with which it is used. It is crucial that a musical instrument reed maintain the proper desired shape, in order for the instrument with which the reed is used to produce the proper sounds.

As musical instrument reeds are relatively thin and fragile and require careful treatment and handling, it is also important that they be properly packaged at the time of manufacture and to the point of sale. Numerous containers and packages for such articles have been developed in the past, but most provide little, if any, retention to hold the reed in the desired shape, particularly after it has been used. Some containers and the like have been developed which attempt to hold or secure the reed in the desired shape or configuration, and/or to promote its drying to the desired shape and form. However, the various reed holders and containers of which the present inventors are aware, all have certain drawbacks which do not provide all of the protection desired for the reed under all circumstances.

Accordingly, a need will be seen for a holder for a musical instrument reed, which holds a single reed securely therein and maintains the proper shape of the reed regardless of the moisture content of the reed. The present reed holder essentially comprises a relatively flat, elongated tube or sleeve having an internal height or thickness adapted to the thickness of the specific reed type which is placed or stored therein. A pair of elongate internal ribs hold the reed securely within the holder, with the flat side or surface of the reed being held securely against the flat interior surface of the holder. Removal of the reed from the holder is easily accomplished by squeezing the sides of the holder slightly, thus flexing the ribbed panel away from the opposite panel of the holder to allow the reed to be withdrawn.

A discussion of the related art of which the present inventors are aware, and its differences and distinctions from the present invention, is provided below.

U.S. Pat. No. 555,561 issued on Mar. 3, 1896 to George R. Cadwallader, titled "Reed Supporter For Clarinets," describes an assembly for holding a reed in place upon the mouthpiece of a clarinet. The Cadwallader assembly comprises a pair of opposed metal loops or bands through which a series of cord windings are looped back and forth to pass over the reed and hold it in place atop the mouthpiece of the instrument. The cords are tightened by a threaded adjuster which engages the two metal loops. Cadwallader does not disclose any means of storing the reed when it is not installed on the mouthpiece of the instrument.

U.S. Pat. No. 1,625,651 issued on Apr. 19, 1927 to Fred Gretsch, titled "Reed Holder," describes a packet having a relatively stiff center panel and a series of reed holding pockets disposed to each side thereof. Gretsch appreciates the need to hold the reeds flat against the center panel, with the pockets having sufficient grip to hold the reeds tightly and securely. However, Gretsch fails to provide for any ventilation to facilitate drying of the reeds after use, and the provision of three pockets on each side of the center panel to hold six reeds, is considerably beyond the need served by the present invention, i.e., to hold a single reed. The Gretsch device is incapable of providing the A proper support for a single reed, as the reeds must be placed in pairs in pockets opposite one another for proper support therein.

U.S. Pat. No. 1,779,522 issued on Oct. 28, 1930 to Charles O. Widmayer, titled "Reed For Clarinets And Saxophones," describes several embodiments of reeds of composite construction, and a system using screws for attaching a reed to the mouthpiece of a musical instrument, as well as a more conventional encircling clamp. Widmayer does not disclose any holder or packaging for a reed for containing and protecting the reed prior to sale, and for storing and holding the reed in its proper configuration after use.

U.S. Pat. No. 2,310,908 issued on Feb. 9, 1943 to Walter Neuerburg, titled "Reed Holder," describes an apparatus for use in an accordion or other reed type musical instrument, for holding the multiple reeds used therein in place. The Neuerburg device is not related to a container type reed holder for storing a single wind instrument reed therein, as provided by the present invention.

U.S. Pat. No. 2,545,599 issued on Mar. 20, 1951 to Carl Bartlett, titled "Reed Holder," describes a flat metal clip in which two pairs of reeds may be stored opposite one another. The Bartlett reed holder slightly elevates the flat surface of the reed above the underlying central panel of the clip, and biases the thin tip of the reed against the central panel to urge the reed tip to bend slightly away from its normal direction of curvature following use. While the Bartlett holder does provide some solutions to some of the problems of reed storage, the metal clip of Bartlett does not allow a person to view the reed, and any information printed thereon, while in the holder. Moreover, the Bartlett holder has no means to facilitate removal of the reed therefrom.

U.S. Pat. No. 2,910,173, issued Oct. 27, 1959 to H. L. Fenburr, describes a package for reeds for musical instruments made in one piece from plastic and having a pair of opposed longitudinal walls, a pair of short, opposed end walls, and a single lateral wall extending the length of the longitudinal walls, which are joined to form a five-sided compartment which is open on the side opposite the lateral side wall. The package has a single shoulder or protrusion on the interior surface of one of the longitudinal walls which is centrally located between the opposing end walls and which extends transversely across more than half of the width of the longitudinal wall. The longitudinal walls are bowed towards each other when the package is empty. The reed is inserted into the case laterally, causing the longitudinal walls to expand to a planar configuration. The transverse shoulder bears against the curved face of the reed, urging the flat surface of the reed against the opposing longitudinal wall. The Fenburr device has no opening defined in the longitudinal side wall for aerating the reed, has no thumb recess for aiding in removal of the reed from the package, does not have longitudinally extending ribs, and is not configured for squeezing the walls of the package to aid in removal of the reed from the package.

U.S. Pat. No. 3,203,298 issued on Aug. 31, 1965 to John N. Sumrall, Jr., titled "Combination Clarinet And Reed Holder," describes a generally conically shaped holder over which the bell of a clarinet may be placed for temporary storage during a musical performance. The conical instrument holder also has a series of flats formed about its surface, with each providing for the placement of a musical instrument reed thereon. A rubber band surrounds the holder to secure the reed(s) thereagainst. The necessity for the conical shape of the Sumrall, Jr. device, for holding the bell of a musical instrument thereon, results in a relatively bulky device which is not suitable for compact storage, as is the present holder. Rather, the Sumrall, Jr. holder must be stored in a conventional musical instrument case, due to its bulk.

U.S. Pat. No. 3,344,913 issued on Oct. 3, 1967 to Melvin H. Best, titled "Container For Musical Reeds." describes a closed container formed of plastic for storing a single musical instrument reed therein. The Best container includes a hinged cover with a crossmember which bears against the curved surface of the reed to hold the flat side of the reed securely against the opposite inner surface of the container. Best states that his container is formed with a slight curvature along its length, which beneficially acts to curve the reed correspondingly. However, Best does not include any ventilation for his closed reed holder container, and the hinged lid arrangement is relatively cumbersome in comparison to the present reed holder invention, which allows the reed to be withdrawn easily from one end of the holder.

U.S. Pat. No. 4,056,997 issued on Nov. 8, 1977 to Philip L. Rovner, titled "Reed Holding Device For Musical Instruments," describes various embodiments of a clamp for securing a reed to the mouthpiece of a musical instrument. No storage container for securing the reed in its proper configuration for drying and storing, is provided by Rovner.

U.S. Pat. No. 4,172,482 issued on Oct. 30, 1979 to Harold M. Gomez, titled "Method And Apparatus For Adjusting Single Reeds For Musical Instruments," describes a jig or fixture for securing a reed therein, with the fixture having a series of slots adjacent the thin lip contact end of the reed clamped therein. Gomez teaches the cutting of one or more slots in the end of the reed, with the cut(s) guided by the slots in the fixture. No container for holding the reed in the proper configuration for storage while drying, is provided by Gomez.

U.S. Pat. No. 4,352,428 issued on Oct. 5, 1982 to Vito S. Pascucci et al., titled "Reed Holder," describes a container providing for the storage of two pairs of reeds therein, in a back-to-back relationship. The reed holding arrangement of the Pascucci et al. holder thus more closely resembles that of the Gretsch '651 reed holder, discussed further above, than it does the present reed holder invention. The Pascucci et al. container has a top or cap which is aligned axially with the main body of the device, and which lifts straight off the body to access the interior of the device, unlike the present holder with its open end which allows the single reed to be inserted or withdrawn therefrom.

U.S. Pat. No. 4,745,838 issued on May 24, 1988 to Conrad O. Johnson, titled "Reed Holding Device For Musical Instruments," describes a clamp for securing a reed to the mouthpiece of a musical instrument. The clamp includes a lower component having a smaller radius lateral curvature than the curvature of the reed, thus contacting the reed only along its outermost edges. No means for storing a reed between uses or packaging the reed prior to sale, is disclosed by Johnson.

U.S. Pat. No. 4,796,507 issued on Jan. 10, 1989 to Terry L. Stibal, titled "Reed Holding Device," describes the use of an elongate strip of Velcro® wrapped around the mouthpiece of a musical instrument, to secure the reed thereto. No means for storing a reed between uses or packaging the reed prior to sale, is disclosed by Stibal.

U.S. Pat. No. 5,221,004 issued on Jun. 22, 1993 to Timothy M. Murphy, titled "Reed Holder," describes various embodiments of a device for holding a plurality of musical instrument reeds therein. The device has a box-like structure, with the reeds being secured against the inner walls of the box by a series of elastic bands. A cylindrical outer cover or container may be provided over the outside of the box, if so desired. The opaque nature of the material used precludes viewing any indicia on the reed, through the box and cover structure. Moreover, the three dimensional box structure of the Murphy reed holder, results in a considerably more bulky article than the present reed holder and its capacity for a single flat reed.

U.S. Pat. No. 5,303,628 issued on Apr. 19, 1994 to Jorge R. Salazar, titled "Mouthpiece For A Clarinet And A Saxophone," describes a mouthpiece having a flared end which conforms more closely to the configuration of the mouth and lips when an instrument is being played. Otherwise, the mouthpiece is conventional, with a lower air passage over which the reed would be installed for play. However, Salazar does not disclose such a reed installation with his mouthpiece, and does not disclose any storage container for holding and storing a musical instrument reed when it is not in use.

U.S. Pat. No. D-399,714 issued on Oct. 30, 1998 to Edward J. Grossi et al., titled "Brushcutting Reed Holder," illustrates a design having a flat center area with a passage therethrough, with opposite raised semicylindrical side members therealong. No container structure for holding and securing a musical instrument reed therein, is provided by the Grossi et al. design.

Finally, U.S. Pat. No. D-409,370 issued on May 11, 1999 to Steven A. Wasser, titled "Reed Holder," illustrates a design comprising a tray having a series of parallel channels formed therein, with a transparent lid for covering the tray. No means for securing a reed firmly against a flat surface to preclude warping while the reed is drying, is apparent in the Wasser design.

None of the above inventions and patents, taken either singly or in combination, is seen to describe the instant invention as claimed. Thus a holder for a musical instrument reed solving the aforementioned problems is desired.

SUMMARY OF THE INVENTION

The present invention comprises a holder or storage device for a musical instrument reed, particularly for a reed used with clarinets and saxophones. The present reed holder has a relatively thin, flat configuration, and is adapted to hold only a single musical instrument reed therein. The present holder is preferably provided at the time of manufacture of the reed, to protect and hold the reed securely therein throughout the distribution and sales process. The present reed holder is particularly useful after sale of the reed, for holding and protecting the reed for storage and transport when not being used with the musical instrument. The configuration of the present reed holder assures that a reed placed therein, will be held in its proper configuration and that it will dry flat, without warping, in order to allow the reed to be used again.

The present holder has a first reed retention panel having a laterally convex curvature thereto, with a pair of longitudinal reed contact ribs extending along the inner surface thereof. The opposite second reed -retention panel is flat. A reed is placed within the present holder with its convex surface in contact with the two internal ribs of the convex first panel, and the flat surface of the reed in contact with the flat second panel of the holder. The two internal ribs apply a pressure on the reed toward the second panel, with the flat surface of the reed conforming to the flat second panel which holds the reed in its proper shape to prevent warping while drying.

Removal of the reed from the reed holder is easily accomplished, by applying pressure on the opposed sides or edges of the holder. This causes the convex first panel to bow further outwardly, thereby releasing the pressure of the internal ribs on the curved surface of the reed held therein and allowing the reed to be withdrawn from the holder. Markings may be provided to indicate the appropriate points on the holder for applying lateral pressure for releasing the internal grip of the holder on the reed contained therein. Thumb and finger recesses are provided at one end of the holder, to facilitate insertion and withdrawal of the reed into and from the holder.

The present reed holder is preferably formed of a translucent or transparent material having at least some limited lateral flexibility, in order to allow the opposite sides to be flexed toward one another to release the retaining pressure on the reed contained therein. Transparency is preferred, in order to allow any markings or identification on the reed to be observed through the holder. The properties of polyethylene plastic provide the desired characteristics for the present holder. Additional features may be provided, such as one or more ventilation passages in at least one of the reed retaining panels and/or at the end of the device opposite the thumb and finger recesses, etc. The present reed holder may be formed to fit closely about any practicable size reed for any corresponding musical instrument, but is particularly well adapted for holding and storing reeds used for clarinets and saxophones.

Accordingly, it is a principal object of the invention to provide a holder for holding and securing a single reed for a musical instrument.

It is another object of the invention to provide such a reed holder having opposed first and second reed retaining panels, with an outwardly bowed first panel having a pair of longitudinal reed contact ribs along the inner surface thereof for holding a reed therein with its flat surface bearing against the flat surface of the second panel to assure that the reed will not warp when drying within the holder.

It is a further object of the invention to form a reed holder from a somewhat flexible and translucent or transparent plastic material, to allow the reed retaining panels to be flexed apart from one another for release of a reed contained therein, and to allow any markings on the reed to be observed through the holder.

Still another object of the invention is to provide at least one, and preferably a plurality of, ventilation passage(s) through the panels and other structure of the holder to promote drying of a damp reed being held therein.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a holder for a musical instrument reed, as used particularly in clarinets and saxophones. Such reeds may be formed of various flexible materials, e.g., metal, plastic, composites, etc., but are normally formed of a bamboo cane reed or other natural material, and are subject to warping with changes in humidity or moisture content of the material. As such, reeds are normally used in a very moist and humid environment, i.e., exposed to the breath of a person playing the musical instrument in which the reed is installed, so that such reeds customarily absorb a great deal of moisture during use. It is important that the reed be held to the desired shape while drying between uses, to preclude warping or other damage to the relatively fragile reed.

Figure 1:
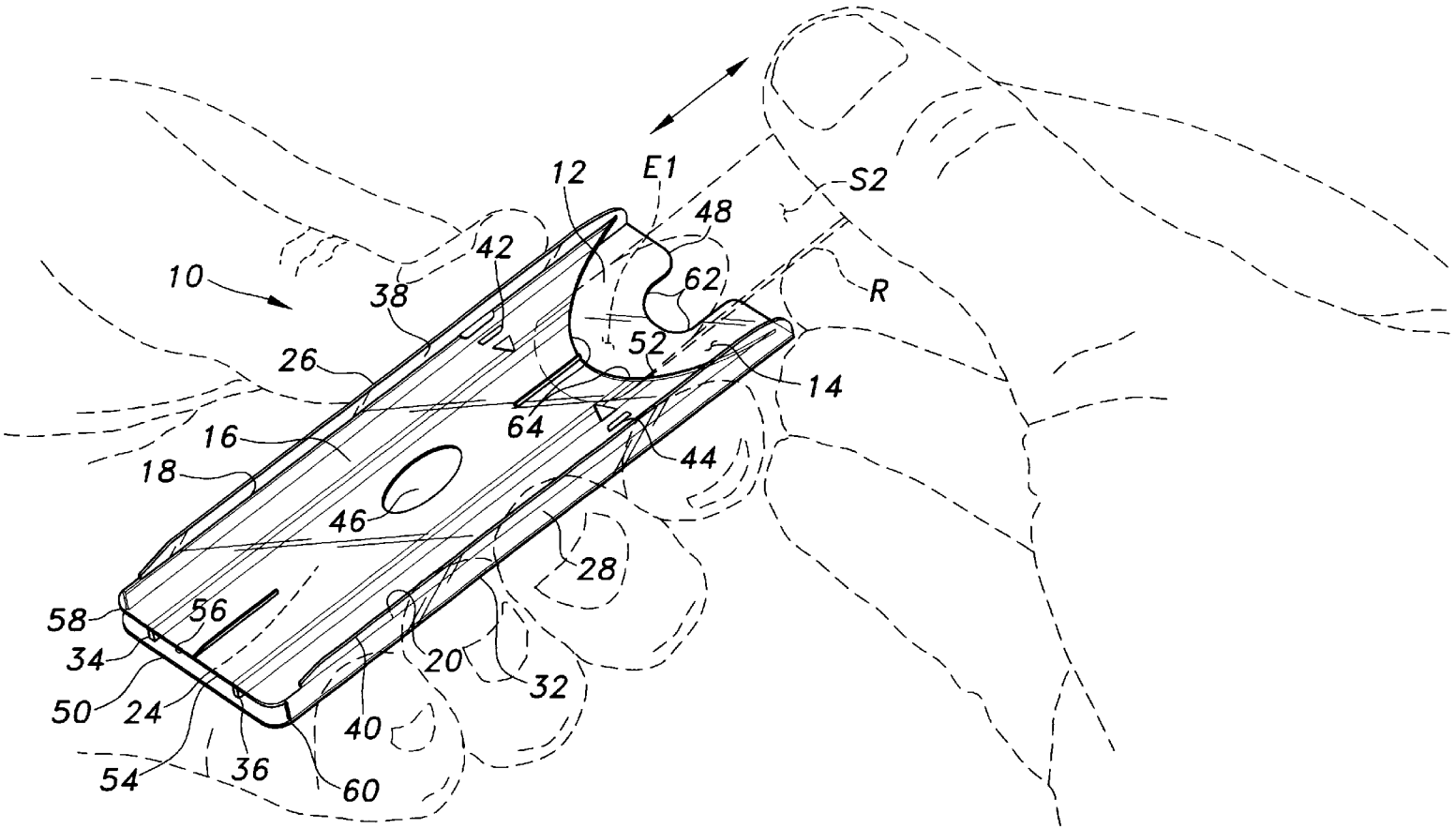
FIG. 1 is an environmental, perspective view of a holder for a musical instrument reed according to the present invention, showing the insertion or withdrawal of a reed therefrom.
Figure 2:
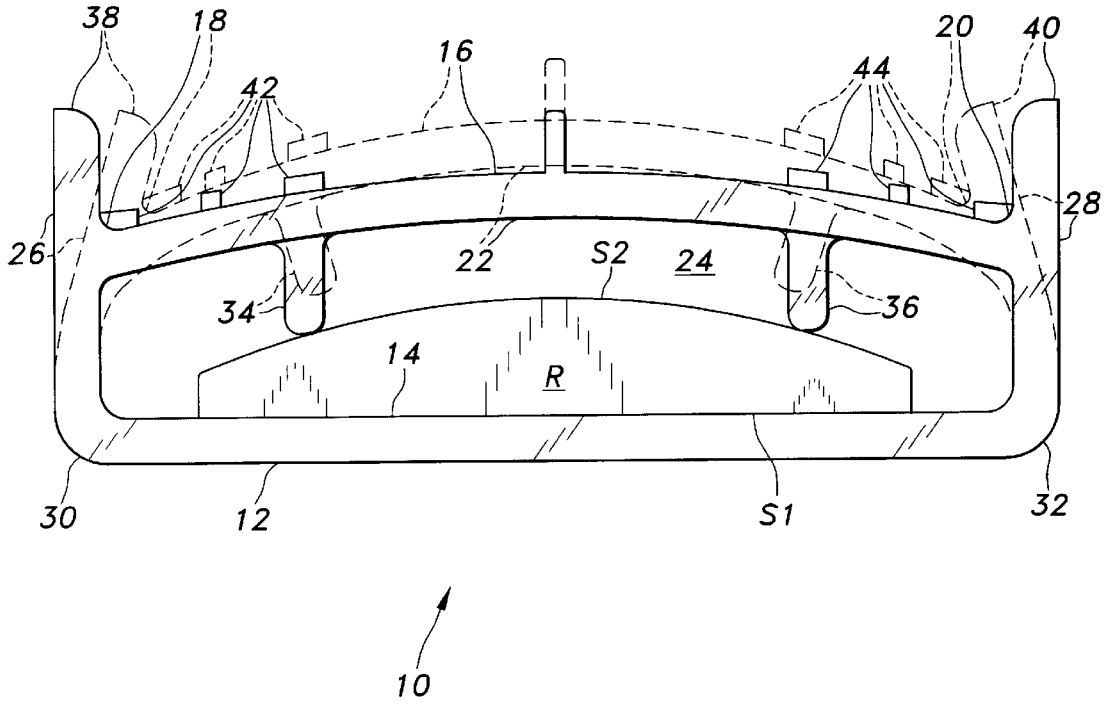
FIG. 2 is an end elevation view of the present reed holder, showing the securing of a reed therein and the flexing of the holder for release of the reed.

FIG. 1 of the drawings provides an environmental perspective view of the present reed holder 10, showing the insertion or withdrawal of a musical instrument reed R therefrom, with FIG. 2 providing a detailed end elevation View showing the fit of the reed R within the interior of the reed holder 10. The present reed holder 10 is specifically configured to hold the reed R precisely and firmly therein, and yet allow the reed R to be readily and easily removed when desired. Musical instrument reeds, at least for clarinets and saxophones, are conventionally configured with a flat first surface S1 and an opposite second surface S2 having a convex shape laterally. The first end E1 of the reed R, i.e., the end which is closest to the lips of the person playing the musical instrument during play of the instrument, is tapered to a very thin, feathered edge to provide the desired vibration due to resonance of the air column passing through the instrument during play. This thin feathered edge of the reed end E1 must be protected when the reed is in storage.

The present reed holder 10 accomplishes this by gripping the reed R firmly between the two opposed major panels of the holder 10, as shown clearly in FIG. 2. The reed holder 10 includes a flat first reed holder panel 12 having a flat internal reed contact surface 14, which bears directly against the flat first side or surface S1 of the reed R when the reed R is placed within the holder 10. An opposite second reed holder panel 16 has a convex lateral curvature, i.e., the second panel 16 has an arcuate shape extending laterally between its two edges 18 and 20.

The arcuate second panel 16 of the reed holder 10 has a correspondingly shaped internal surface 22, which substantially approximates the lateral curvature of the second surface S2 of the reed R. The two opposed panels 12 and 16, or more accurately their respective interior surfaces 14 and 22, define an internal volume or cavity 24 for holding a single musical instrument reed R therein, as illustrated in FIGS. 1 and 2. The two panels 12 and 16 are fixed relative to one another by first and second side walls, respectively 26 and 28, which extend respectively between the first edge 30 of the first panel 12 and the corresponding first edge 18 of the second panel 16, and the second edge 32 of the first panel 12 and corresponding second edge 20 of the second panel 16.

The internal cavity 24 has a height which is somewhat greater than the thickness of the reed R, as can be seen in the end elevation view of FIG. 2. Accordingly, longitudinally disposed, laterally spaced apart first and second reed contact ribs 34 and 36 extend into the internal cavity 24 of the reed holder 10, from the internal surface 22 of the laterally curved second panel 16. The height or depth of the two ribs 34 and 36 is such that their distal ends, i.e., the ends opposite their attachment to the second panel 16, bear against the curved surface S2 of a reed R installed within the reed holder 10, when the holder 10 is in its normal state. The pressure applied by the ribs 34 and 36 against the surface S2 of the reed R, holds the opposite flat surface S1 of the reed R firmly against the flat internal surface 14 of the first panel 12, thereby preventing warping of the reed R as it dries.

The reed holder 10 is formed of a flexible, resilient plastic material, e.g. polypropylene, to provide the required flexibility and resiliency for the device as needed to apply pressure to the reed R for retaining the reed R in the holder 10, while permitting the release of pressure upon the reed R stored therein by flexing the holder, whereupon the holder 10 returns to its original configuration after removal of the reed R. The plastic material is preferably transparent, or at least translucent, in order that any markings (e.g., manufacturer, voice or pitch, etc.) marked on the reed R may be viewed through the transparent or translucent panel(s) 12 and/or 16. Compressive pressure applied to the two opposite side walls 26 and 28 results in the side walls 26 and 28 flexing inwardly, particularly at their upper junctures 18 and 20 with the curved second panel 16.

The outward lateral curvature of the second panel 16, results in the panel 16 flexing outwardly as its two edges 18 and 20 are compressed inwardly toward one another. This lifts the two ribs 34 and 36 from the curved surface S2 of the reed R held therein, and allows the reed R to be removed for use. The same procedure is used to allow the reed R to be inserted into the holder 10, or the tapered reed end E1 may simply be inserted into the holder 10, with the tapered end E1 wedging the second panel 16 with its ribs 34 and 36, apart from the opposite first panel 12. The two side walls 26 and 28 may include upward extensions, respectively 38 and 40, to assist the user in applying pressure to the side walls 26 and 28, as well as to provide an air space between holders when a series of holders is stacked atop one another. A pair of opposed pressure application indicators 42 and 44 may be provided on the second panel 16 adjacent each side wall 26 and 28 to indicate the appropriate "squeeze point" to the user of the device.

Figure 3:
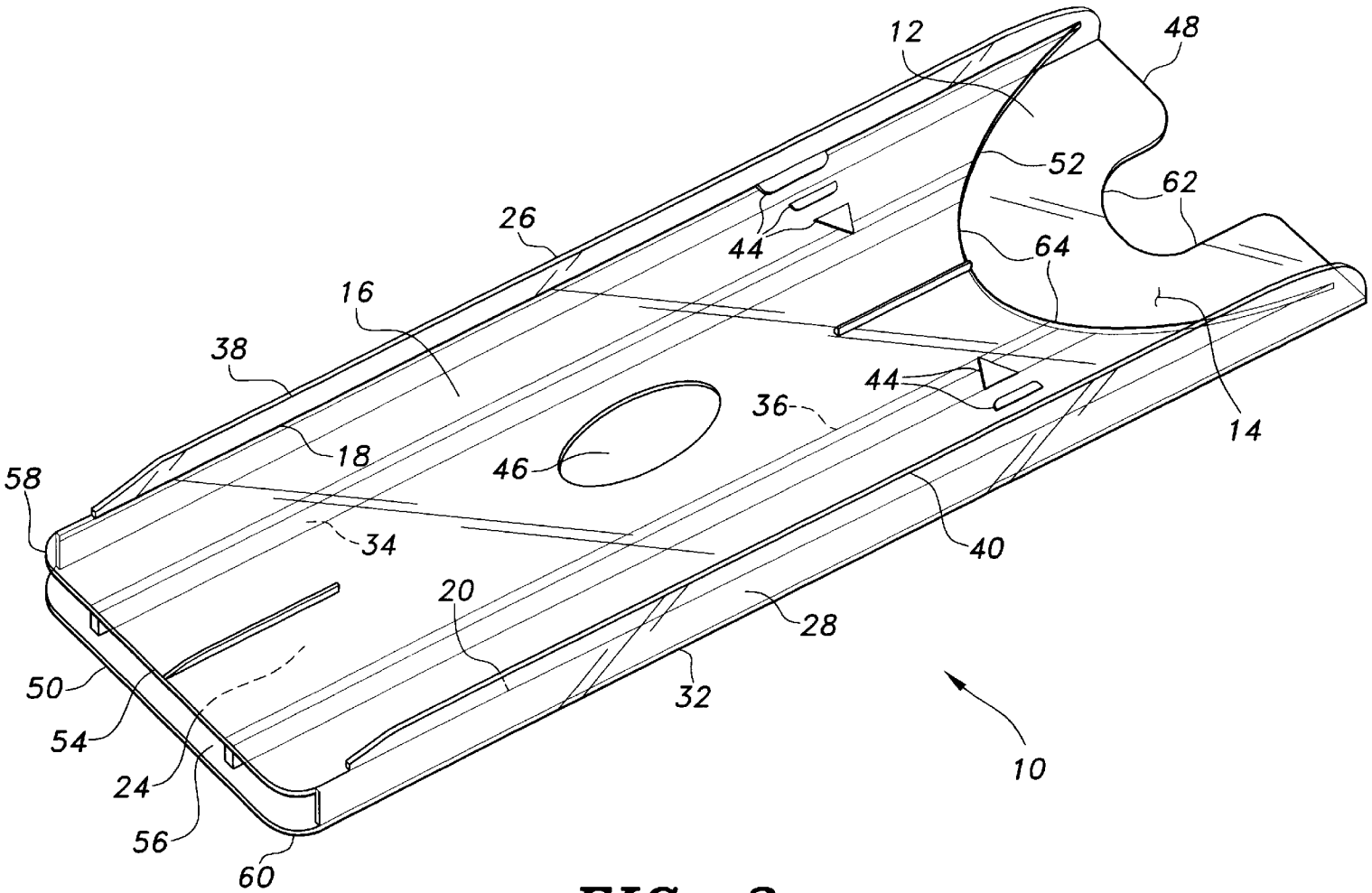
FIG. 3 is a perspective view of the present holder for a musical instrument reed according to FIG. 1, with environmental features removed for clarity in the drawing.

It is important that a reed R placed within the present holder 10 after use, be provided with sufficient air circulation to allow the reed R to dry. The present holder provides for such air circulation by means of at least one ventilation passage 46 formed through the curved second panel 16. While only a single vent passage 46 is illustrated in FIGS. 1 and 3 of the drawings, it will be seen that additional passages may be provided through the second panel 16, and/or the flat first panel 12, if so desired. While an oval shaped air ventilation passage 46 is illustrated, it will be seen that such a vent passage(s) may be formed to have any practicable shape, as desired.

In addition, the opposed first and second ends, respectively 48, 50 for the first panel 12, and 52, 54 for the second panel 16, are completely open, with the open second end defining an open ventilation passage 56 between the two second ends 50 and 54 of the two panels 12 and 16. This allows airflow to circulate along the length of the device, as well as through any intermediate vents 46 provided through the panel(s) 16 and/or 12. Preferably, the first and second corners 58 and 60 of the two panels 12 and 16, defined by the respective junctures of their first and second edges 18, 20 and 30, 32 with their second ends 50 and 54, are smoothly rounded by a radius curve in order to avoid snagging upon any fabric material, e.g., the inner liner of a pocket, etc., when the device is carried therein. The opposite corners 62 and 64 of the first ends 48 and 52 of the two panels 12 and 16 may be smoothly rounded in a similar manner.

The first ends 48 and 52 of the two panels 12 and 16 are also configured to facilitate the insertion and removal of the musical instrument reed R therein and therefrom. Preferably, the first end 48 of the first panel 12 includes a finger relief or cutout 62 formed therein, with the first end 52 of the second panel 16 having a thumb recess or cutout 64 formed therein. (It will be understood that the terms "thumb recess or cutout" and "finger recess or cutout" are not intended to limit the function of the cutouts in such a manner, but merely to provide descriptive phrases for the two reliefs.) The two reliefs 62 and 64 allow a reed R to be inserted completely into the holder 10, between the two side walls 26 and 28, to completely protect the entire reed R. Yet, the two reliefs 62 and 64 enable a user of the present reed holder 10, to grip the end of the reed R which has been completely inserted into the holder 10, between the two extended side walls 26 and 28, in order to insert the reed R completely into the holder 10, or to withdraw a completely inserted reed R from the holder 10.

In conclusion, the present holder for musical instrument reeds provides a superior means of holding and protecting a musical instrument reed, and holding the reed in the desired position in order to prevent warping while drying after use. The present reed holder provides superior protection for the reed during shipping after manufacture, and while in the shop prior to sale. The present holder also provides continued protection for the reed after purchase, enabling the musician to use the holder to protect the reed and prolong its life and quality.

The present holder is formed as a single, unitary, monolithic structure, with no mechanically connected parts and no moving parts other than the flexibility provided for the side walls and second panel, as described further above. Accordingly, the present reed holder is extremely economical to manufacture, and will pay for itself in terms of prolonging the life of a musical instrument reed stored therein. The present reed holder will thus find great favor among musicians who value their equipment, and who wish to maintain the reeds for their wind instruments for a longer period of time.

It is to be understood that the present invention is not limited to the embodiments described above, but encompasses any and all embodiments within the scope of the following claims.

We claim:

1. A holder for a musical instrument reed, comprising:

a flat first elongate panel having an internal reed contact surface;

a second elongate panel having a convex lateral curvature opposite said first panel and having an internal surface;

said first panel and said second panel each having a first edge, a second edge opposite said first edge, a first end, and a second end opposite said first end;

a first side wall joining each said first edge of said first and said second panel;

a second side wall joining each said second edge of said first and said second panel, said first and second panels and said first and second side walls defining a cavity; and at least said first panel, said second panel, said first side wall, and said second side wall being formed of a flexible, resilient material, whereby compressive force applied to said first and said second side wall deflects each said side wall toward one another and spreads said convex second panel away from said first panel, in order to relieve a retaining pressure exerted by said first and second panels on a musical instrument reed retained in said cavity.

2. The holder according to claim 1, further including first and second longitudinally extending reed contact ribs disposed upon said internal surface of said second panel and extending into said cavity, the ribs being spaced apart laterally, for applying pressure upon the musical instrument reed contained within said reed holding volume and holding the reed in a flat disposition to prevent warping thereof.

3. The holder according to claim 1, further including pressure application indicators disposed upon at least said second panel adjacent each said side wall.

4. The holder according to claim 1, wherein at least said first panel and said second panel are formed of a translucent plastic material.

5. The holder according to claim 1, wherein said first and second panels and said first and second side walls are formed as a unitary structure made from polypropylene.

6. The holder according to claim 1, wherein at least said second panel further includes at least one ventilation passage formed therethrough.

7. The holder according to claim 1, wherein the second ends of said first panel and said second panel define an open ventilation passage disposed therebetween.

8. The holder according to claim 1, wherein:

said first end of said first panel further includes a finger relief formed therein; and said second end of said second panel further includes a thumb relief formed therein.

9. The holder according to claim 1, wherein the first edge and the second end of each said panel and the second edge and the second end of each said panel, respectively, define a smoothly rounded first corner and second corner.

10. A musical instrument reed in combination with a reed holder therefor, comprising:

a musical instrument reed having a flat first surface and a laterally convex second surface opposite said first surface;

a flat first elongate panel having an internal reed contact surface;

a second elongate panel having a convex lateral curvature opposite said first panel and having an internal surface;

said first panel and said second panel each having a first edge, a second edge opposite said first edge, a first end, and a second end opposite said first end;

a first side wall joining each said first edge of said first and said second panel;

a second side wall joining each said second edge of said first and said second panel, said first and second panels and said first and second side walls defining a cavity; and at least said first panel, said second panel, said first side wall, and said second side wall being formed of a flexible, resilient material;

wherein said reed is contained within said cavity for transport and storage, being retained therein by resilient pressure of said first and second panels on said reed; and wherein a compressive force applied to said first and said second side walls deflects each said side wall toward one another and spreads said convex second panel away from said first panel, in order to relieve the retaining pressure exerted by said first and second panels on said reed for removal of said reed from said cavity.

11. The musical instrument reed and reed holder combination according to claim 10, further including first and second longitudinally extending reed contact ribs disposed upon said internal surface of said second panel and extending into said cavity, the ribs being spaced apart laterally, for applying pressure upon the musical instrument reed contained within said reed holding volume and holding the reed in a flat disposition to prevent warping thereof.

12. The musical instrument reed and reed holder combination according to claim 10, further including pressure application indicators disposed upon at least said second reed holder panel adjacent each said reed holder side wall.

13. The musical instrument reed and reed holder combination according to claim 10, wherein at least said first panel and said second panel are formed of a translucent plastic material.

14. The musical instrument reed and reed holder combination according to claim 13, wherein said first and second panels and said first and second side walls are formed as a unitary structure made from polypropylene.

15. The musical instrument reed and reed holder combination according to claim 10, wherein at least said second reed holder panel further includes at least one ventilation passage formed therethrough.

16. The musical instrument reed and reed holder combination according to claim 10, wherein the second ends of said first reed holder panel and said second reed holder panel define an open ventilation passage disposed therebetween.

17. The musical instrument reed and reed holder combination according to claim 10, wherein:

the first end of said first reed holder panel further includes a finger relief formed therein; and the second end of said second reed holder panel further includes a thumb relief formed therein.

18. The musical instrument reed and reed holder combination according to claim 10, wherein the first edge and the second end of each said reed holder panel and the second edge and the second end of each said reed holder panel, respectively define a smoothly rounded first reed holder corner and second reed holder corner.

19. The musical instrument reed and reed holder combination according to claim 10, wherein said musical instrument reed is formed of materials selected from the group consisting of cane, bamboo, plastic, a composite material, and metal.

* * * * *